US008899275B2

(12) United States Patent
Stewart

(10) Patent No.: US 8,899,275 B2
(45) Date of Patent: Dec. 2, 2014

(54) APPARATUS AND METHOD FOR LOADING TUFTS INTO A TUFT CARRIER

(75) Inventor: Richard Stewart, County Down (IE)

(73) Assignee: Ulster Carpet Mills (Holdings) Limited, Craigavon (GB)

( * ) Notice: Subject to any disclaimer, the term of this patent is extended or adjusted under 35 U.S.C. 154(b) by 101 days.

(21) Appl. No.: 13/876,929

(22) PCT Filed: Oct. 5, 2011

(86) PCT No.: PCT/GB2011/051905

§ 371 (c)(1),
(2), (4) Date: Aug. 2, 2013

(87) PCT Pub. No.: WO2012/046056

PCT Pub. Date: Apr. 12, 2012

(65) Prior Publication Data

US 2014/0076453 A1 Mar. 20, 2014

(30) Foreign Application Priority Data

Oct. 6, 2010 (GB) ..... 1016785.6

(51) Int. Cl.

| | |
|---|---|
| ***D03D 39/06*** | (2006.01) |
| ***D03D 39/02*** | (2006.01) |
| ***D03D 39/08*** | (2006.01) |
| *D03D 39/00* | (2006.01) |

(52) U.S. Cl.
CPC ..... *D03D 39/08* (2013.01)
USPC ..... 139/7 A; 139/7 F; 139/7 D; 139/7 R

(58) Field of Classification Search
CPC ..... D03D 39/08; D03D 39/02; D05C 15/18
See application file for complete search history.

(56) References Cited

U.S. PATENT DOCUMENTS 3,387,577 A * 6/1968 Barton et al. ..... 112/80.07
3,415,209 A * 12/1968 Ronald et al. ..... 112/80.17

(Continued)

FOREIGN PATENT DOCUMENTS

EP 1 970 476 A1 9/2008
GB 1 337 722 11/1973

(Continued)

OTHER PUBLICATIONS

International Search Report and Written Opinion of corresponding International Application No. PCT/GB2011/051905, dated Mar. 5, 2012.

(Continued)

*Primary Examiner* — Bobby Muromoto, Jr.
(74) *Attorney, Agent, or Firm* — Renner, Otto, Boisselle & Sklar, LLP

(57) ABSTRACT

A tuft carrier loading apparatus (10) for loading individual tufts (17) into tuft retention sites (9*a*) spaced along an elongate tuft carrier (9). The apparatus (10) includes a guide for guiding longitudinal movement of the tuft carrier along a path of travel and a plurality of individually and selectively operable tuft feeders (50) spaced along the path of travel, each tuft feeder (50) being operable when selected to feed an individual tuft to a tuft retention site (9*a*) of the tuft carrier (9). A driver (70) is drivingly connected to the tuft carrier (9) for moving the tuft carrier (9) along the path of travel, the driver (70) being operable to intermittently move the tuft carrier (9) through a series of successive positions whereat predefined tuft retention sites (9*a*) are moved temporarily into registry with each tuft feeder (50). A controller (60) is provided for controlling selection of the tuft feeders (50), the controller (60) being operable to actuate selected tuft feeders (50) to feed tufts to those tuft retention sites (9*a*) in registry therewith whilst the carrier (9) is located at each successive position. A detector is associated with each tuft retention site (9*a*) to detect the presence of a tuft. The driver (70), on detection of an absent tuft in a tuft retention site (9*a*) following actuation of one or more selected tuft feeders (50) resulting in failure to feed a tuft to the absent tuft retention site (9*a*), is operable to move the tuft carrier (9) into a position whereat the absent tuft retention site (9*a*) is moved temporarily back into registry with the or one selected tuft feeder (50) and the controller (60) re-actuates the selected tuft feeder (50) to feed a tuft to the absent tuft retention site (9*a*).

14 Claims, 10 Drawing Sheets

(56) References Cited

U.S. PATENT DOCUMENTS

| | | | | |
|---|---|---|---|---|
| 3,741,139 | A * | 6/1973 | Frentress | 112/80.08 |
| 3,807,459 | A * | 4/1974 | Tolley | 139/7 D |
| 4,039,007 | A * | 8/1977 | Coleman et al. | 139/7 F |
| 5,743,306 | A * | 4/1998 | Stewart et al. | 139/7 A |
| 6,220,307 | B1 * | 4/2001 | Griffith | 139/7 A |
| 6,289,938 | B1 * | 9/2001 | Dewispelaere | 139/7 A |
| 6,293,314 | B1 * | 9/2001 | Dewispelaere | 139/2 |
| 6,701,970 | B2 * | 3/2004 | Burton | 139/7 A |
| 6,820,656 | B2 * | 11/2004 | Burton | 139/7 A |
| 6,893,100 | B1 * | 5/2005 | Hottmann et al. | 300/7 |
| 6,935,257 | B2 * | 8/2005 | Griffith | 112/80.73 |
| 6,935,381 | B2 * | 8/2005 | Debuf et al. | 139/2 |
| 6,994,121 | B2 * | 2/2006 | Burton | 139/7 A |
| 7,007,721 | B2 * | 3/2006 | Bassi et al. | 139/59 |
| 7,044,172 | B2 * | 5/2006 | Stewart | 139/7 A |
| 7,392,829 | B2 * | 7/2008 | Griffith | 139/7 A |
| 8,256,364 | B2 * | 9/2012 | Vaughan et al. | 112/475.23 |
| 8,387,667 | B2 * | 3/2013 | Burton et al. | 139/2 |
| 8,770,122 | B2 * | 7/2014 | Vaughan et al. | 112/80.73 |
| 2004/0035340 | A1 * | 2/2004 | Stewart | 112/80.73 |

FOREIGN PATENT DOCUMENTS

| | | |
|---|---|---|
| GB | 2 096 651 | 10/1982 |
| GB | 2 096 651 A | 10/1982 |
| GB | 2 367 076 A | 3/2002 |
| WO | 95/31594 | 11/1995 |

OTHER PUBLICATIONS

International Search Report, PCT/GB2011/051905.

UK Intellectual Property Office for Search Report; Application No. GB1016785.6; Date of search Jan. 21, 2011.

* cited by examiner

APPARATUS AND METHOD FOR LOADING TUFTS INTO A TUFT CARRIER

The invention relates to an apparatus and method for loading tufts into a tuft carrier for use with a gripper loom particularly, but not exclusively, an Axminster gripper loom.

The invention also relates to a loom incorporating the tuft loading apparatus and a method of weaving on a loom.

In a conventional jacquard Axminster loom, grippers are provided across the width of the loom to present tufts for insertion into a carpet being woven on the loom. Supplies of tuft yarn are fed into yarn carriers, which also extend across the width of the loom in correspondence with the grippers. Each yarn carrier includes a yarn end for each colour required by the pattern of the carpet. A jacquard controls movement of the yarn carriers so as to present a selected yarn end to each gripper for each row of the carpet. The grippers draw a predetermined length of the presented yarns ends, which are cut by a series of knives. The grippers then insert the resultant tufts between warp threads, the tufts being held in position in the resultant carpet by each pass of the weft yarn.

In a typical 4 yard wide loom with a pitch of 7 tufts per inch, 1008 tufts are inserted into a carpet across its width in each row. This means that setting up the loom to weave a carpet including 8 different colours results in a creel including 8 bobbins of yarn per tuft insertion point, namely 8064 bobbins of yarn.

A spool gripper loom employs a smaller number of bobbins to supply an off-line spool winding process. Each spool in the complete set has a pre-selected set of colours appropriate to a particular row in the carpet, and thus allows more yarn colours to be used. The need to pre-wind spools however means that a greater quantity of yarn is used than would be the case on a gripper loom. Spool gripper looms are therefore more suitable for use in larger batch quantities. A further disadvantage with the spool gripper loom is that the pattern repeat length is limited to the number of spools in the supply system.

WO 95/31594 describes a tuft carrier loading apparatus for a gripper loom that greatly reduces the number of bobbins required in the creel of a gripper loom. The tuft carrier loading apparatus includes an elongate tuft carrier having a plurality of tuft retention sites into which tufts of yarn are fed in a sequential manner. Following the insertion of a complete row of tufts into the tuft carrier, the tuft carrier presents the tufts to the grippers of the loom for insertion into a carpet as a complete row.

According to a first aspect of the invention there is provided a tuft carrier loading apparatus for loading individual tufts into tuft retention sites spaced along an elongate tuft carrier, the apparatus including:

a guide for guiding longitudinal movement of the tuft carrier along a path of travel;

a plurality of individually and selectively operable tuft feeders spaced along the path of travel, each tuft feeder being operable when selected to feed an individual tuft to a tuft retention site of the tuft carrier;

a driver drivingly connected to the tuft carrier for moving the tuft carrier along the path of travel, the driver being operable to intermittently move the tuft carrier through a series of successive positions whereat predefined tuft retention sites are moved temporarily into registry with each tuft feeder; and a controller for controlling selection of the tuft feeders, the controller being operable to actuate selected tuft feeders to feed tufts to those tuft retention sites in registry therewith whilst the carrier is located at each successive position, characterised in that the tuft carrier loading apparatus further includes a detector associated with each tuft retention site to detect the presence of a tuft and the driver, on detection of an absent tuft in a tuft retention site following actuation of one or more selected tuft feeders resulting in failure to feed a tuft to the absent tuft retention site, is operable to move the tuft carrier into a position whereat the absent tuft retention site is moved temporarily back into registry with the or one selected tuft feeder and the controller re-actuates the selected tuft feeder to feed a tuft to the absent tuft retention site.

The use of a tuft carrier loading apparatus that allows movement of the tuft carrier into a position whereat an absent tuft retention site is moved temporarily back into registry with a selected tuft feeder and re-actuation of the selected tuft feeder to feed a tuft to the absent tuft retention site allows the apparatus to seek to correct an error in the row of tufts before they are presented to the grippers of a loom for insertion into a carpet.

This is advantageous in that it eliminates the need for a skilled craftsperson to examine the resultant carpet to identify faults in the carpet arising from absent tufts and to insert those missing tufts by hand.

This is a particularly time consuming exercise and seeking to correct any errors in a row of tufts before they are presented to the grippers of a loom for insertion into a carpet thereby improves the efficiency of the carpet manufacturing process in terms of both time and cost.

The nature of the tuft yarn used in carpets means that a tuft feeder might fail to feed a tuft into a tuft retention site for a number of reasons. An accumulation of fluff or stray yarns, or a knot in a yarn end, may for example cause the tuft feeder to fail. The applicant has discovered that typically in a significant number of such failures, the apparent fault will rectify itself with no manual intervention from a loom operator and allow the tuft feeder to feed a tuft successfully on re-actuation of the tuft feeder.

In a preferred embodiment, the tuft feeders may include primary and secondary tuft feeders in sequence for predefined tuft retention sites, the primary and secondary tuft feeders being supplied with tuft yarn having the same characteristic, and the controller is operable to select and actuate the primary tuft feeders to feed tufts to the predefined tuft retention sites when they are moved temporarily into registry therewith and, on detection of an absent tuft in one or more of the predefined tuft retention sites following actuation of the corresponding primary tuft feeder resulting in failure to feed a tuft to the absent tuft retention site, the controller being operable to select and actuate the corresponding secondary tuft feeder to feed a tuft to the absent tuft retention site when it is moved temporarily into registry therewith.

In such an embodiment the apparatus will seek to fill an absent tuft retention site, following failure of a primary tuft feeder to feed a tuft to the absent tuft retention site, when the absent tuft retention site is moved into registry with a corresponding secondary tuft feeder. The provision of primary and secondary tuft feeders thereby allows the apparatus to make a second attempt to fill the absent tuft retention site, before seeking to re-actuate the primary tuft feeder, and thereby increases the chances of the apparatus succeeding in seeking to correct an error in a row of tufts.

The provision of primary and secondary tuft feeders in sequence for predefined tuft retention sites is particularly advantageous when the tuft carrier loading apparatus is used in a loom set up to weave a carpet in which one particular colour of yarn is dominant. The dominance of the one particular colour of yarn means that failure of one or more of the tuft feeders supplied with tuft yarn of that colour will have a greater effect on the weaving process in terms of loom downtime than failure of one or more of the tuft feeders supplied with tuft yarns of other colours.

The controller of the tuft carrier loading apparatus preferably stops operation of the apparatus on detection of an absent tuft in a tuft retention site following re-actuation of the selected tuft feeder resulting in failure to feed a tuft to the absent tuft retention site.

This allows the absent tuft retention site to be corrected by the manual intervention of a loom operator and thereby ensures that a fault caused by the absence of a tuft is not introduced into a carpet as a result of an incomplete row of tufts being presented to the grippers of the loom. It also allows the loom operator to check the or each faulty tuft feeder and rectify any fault that he identifies so as to reduce the possibility of the or each faulty tuft feeder continuing to fail. The loom operator might, for example, need to re-feed a yarn end to the tuft feeder or remove a knot from the yarn end fed into the tuft feeder and preventing feeding of a tuft from the tuft feeder.

So as to assist the loom operator to readily locate the absent tuft retention site, and thereby reduce the cessation time of a loom incorporating the tuft carrier loading apparatus, a display may be provided to display information identifying any absent tuft retention sites.

According to a second aspect of the invention there is provided a weaving loom including a tuft carrier loading apparatus according to the first aspect of the invention. The weaving loom is preferably an Axminster gripper loom.

According to a third aspect of the invention there is provided a method of loading an elongate tuft carrier with tufts, the elongate tuft carrier having a plurality of tuft retention sites spaced along its length, the method including the steps of:

guiding longitudinal movement of the tuft carrier along a path of travel, arranging a plurality of individually and selectively operable tuft feeders in spaced relationship along the path of travel, driving the tuft carrier intermittently through a series of successive positions so that predefined tuft retention sites are moved temporarily into registry with each tuft feeder, and selecting and actuating selected tuft feeders to feed tufts to those tuft retention sites in registry therewith whilst the tuft carrier is located at each successive position, characterised in that the method further includes the steps of detecting the presence of a tuft in each tuft retention site and, on detection of an absent tuft in a tuft retention site following actuation of one or more selected tuft feeders resulting in failure to feed a tuft to the absent tuft retention site, driving the tuft carrier into a position whereat the absent tuft retention site is moved temporarily back into registry with the or one selected tuft feeder and re-actuating the selected tuft feeder to feed a tuft to the absent tuft retention site.

According to a fourth aspect of the invention there is provided a method of weaving on an Axminster loom wherein for each pick of the loom, a tuft carrier loaded with tufts according to the method of the third aspect of the invention is arranged to present the tufts to the grippers of the loom.

In this specification, the term "yarn carrier" relates to the carrier which locates the yarn ends and is normally selected by a jacquard system, and the term "tuft carrier" relates to the carrier which carries a single, pre-selected row of tufts.

Figure 1:
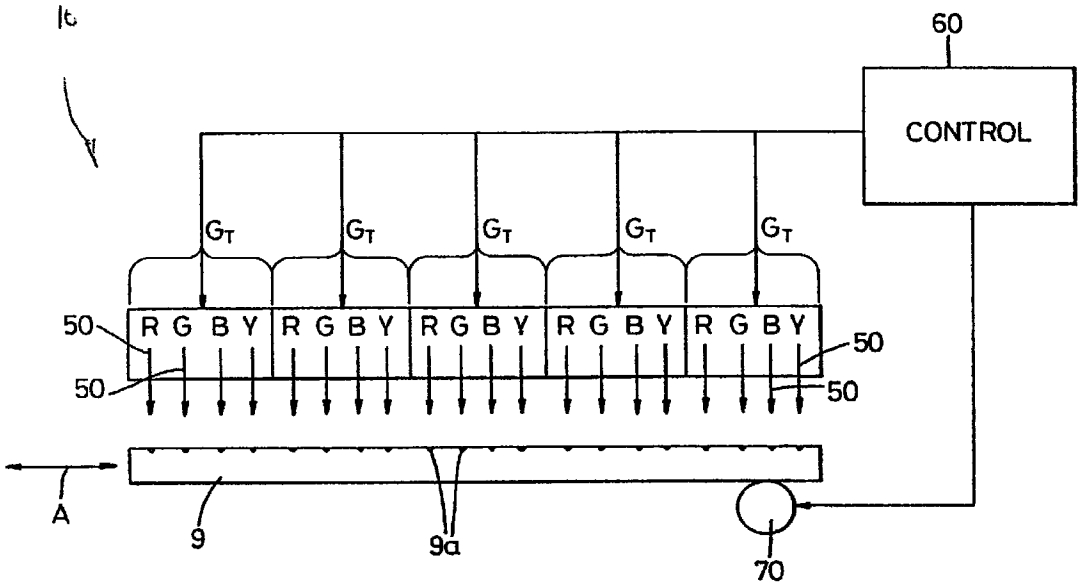
FIG. 1 is a schematic diagram of a tuft carrier loading apparatus according to an embodiment of the invention.

A tuft carrier loading apparatus 10 for loading individual tufts into tuft retention sites 9*a* of an elongate tuft carrier 9, according to an embodiment of the invention, is shown schematically in FIG. 1.

Figure 6:
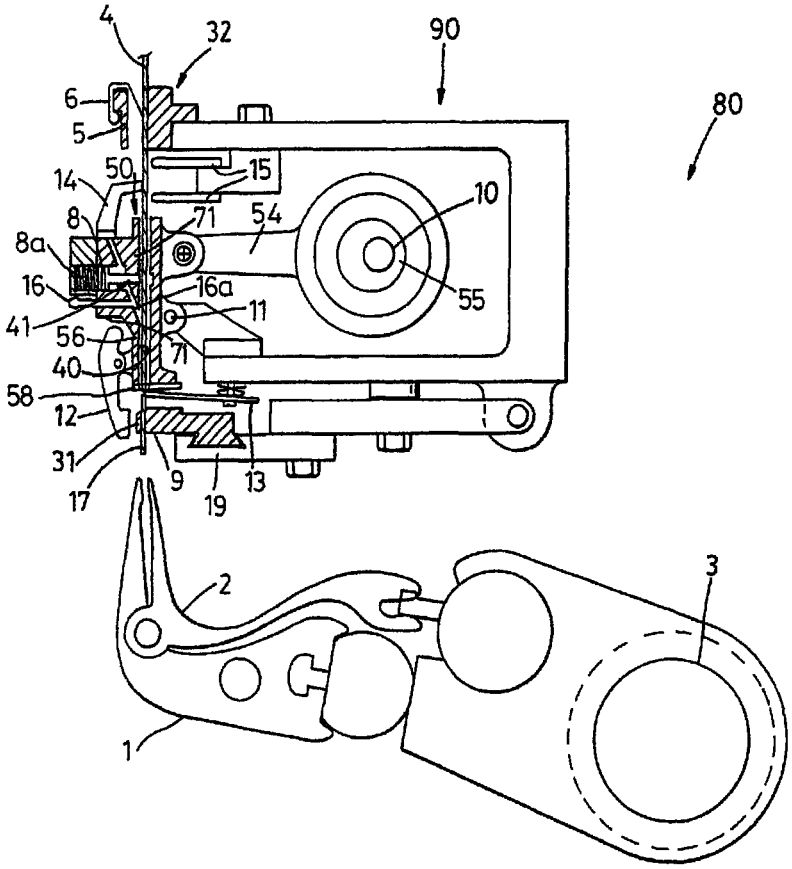
FIG. 6 is a part side view of a loom including the tuft carrier loading apparatus shown in FIG. 1.

The tuft retention sites 9*a* are spaced along one side of the tuft carrier 9, and are spaced apart by the same spacing as between the grippers 1 (FIG. 6) of the loom in which the tuft carrier loading apparatus 10 is incorporated.

Figure 3:
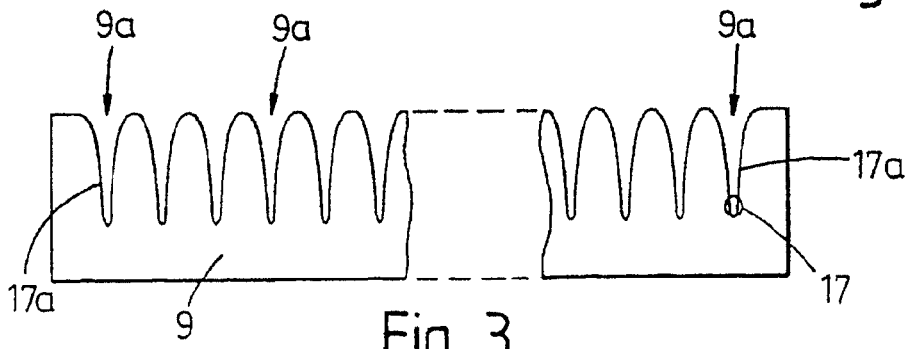
FIG. 3 is a plan view of the tuft carrier of the tuft carrier loading apparatus shown in FIG. 1.

The carrier 9 is preferably rigid, and is adapted to securely hold each tuft 17 (FIG. 3). This is preferably achieved by shaping the profile of each slot 17*a* defining a tuft retention site 9*a* such that the inherent elasticity of the tuft yarn forming the tuft 17 holds the tuft 17 at the bottom of the slot 17*a* when pressed therein.

It is envisaged that other methods may be adopted for retaining the tuft 17. The carrier 9 may, for example, be adapted such that at least one or both opposing sides of each slot 17*a* is formed of a resilient material capable of gripping a tuft 17 presented into the slot 17*a*. In another arrangement the sides of the slot 17*a* may be rigid and a resilient clip may be provided to hold the tuft 17 in place.

The apparatus includes a guide (not shown) for guiding longitudinal movement of the tuft carrier 9 along a path of travel, indicated by arrow A in FIG. 1.

A plurality of tuft feeders 50 are spaced along the path of travel, the spacing between adjacent tuft feeders 50 preferably being equal to the spacing between adjacent tuft retention sites 9*a*.

Each tuft feeder 50 is supplied with one yarn end and, in the embodiment shown in FIG. 1, the yarn ends are arranged such that adjacent tuft feeders 50 are supplied with yarns of different colour. Normally the characteristic of each yarn will be colour of the yarn. In other embodiments however the yarn ends supplied to adjacent tuft feeders 50 may differ from each other in terms of another characteristic such as yarn weight, type or a combination thereof.

In FIG. 1 four different coloured yarns are supplied to the tuft feeders. These are designated R, G, B, Y. The yarns are preferably arranged in a sequence which, as shown in FIG. 1, is repeated along the path of travel. The tuft feeders 50 are therefore divided into groups $G_T$ spaced along the path of travel, each group containing an identical sequence of yarns.

Each tuft feeder 50 is individually selectable such that, on actuation, a selected tuft feeder 50 functions to feed a tuft to a tuft retention site 9*a* in registry therewith. If the tuft feeder 50 is not selected, then it does not supply a tuft to the tuft retention site 9*a* in registry therewith.

A driver 70 is drivingly connected to the tuft carrier 9 for moving the tuft carrier 9 along the path of travel and a controller 60 is also provided, which operates to control selection and actuation of each tuft feeder 50.

Preferably the controller 60 is electronically operable to control the tuft feeders 50, and is programmable so as to enable different combinations of tufts to be loaded into the tuft retention sites 9*a* of the tuft carrier 9 in response to a predetermined pattern.

In use, the driver 70 is operable intermittently to drive movement of the tuft carrier 9 along the path of travel through a series of successive positions so as to temporarily move predefined tuft retention sites 9*a* into registry with each tuft feeder 50.

In the specific embodiment shown in FIG. 1, the driver 70 moves the tuft carrier 9 through a sequence of four steps during the tuft loading process. Preferably the driver 70 operates under the control of the controller 60 such that the controller 60 selectively determines each loading position of the tuft carrier 9 during the loading process. In preferred embodiments, the driver 70 may be provided in the form of a stepper motor, which drives the tuft carrier 9 through a gear transmission.

In other embodiments it is envisaged that the tuft carrier 9 may be driven through a set sequence of loading positions using a cam drive, another similar fixed mechanical drive, a servo system or another linear actuator.

The tuft loading process will now be described with reference to FIGS. 1 and 2 where the number of tuft feeders 50 is the same as the number of tuft retention sites 9*a* in the tuft carrier 9.

At the start of the loading process, the tuft carrier 9 is located at a first loading position (as shown) whereat each tuft retention site 9*a* is in registry with a respective tuft feeder 50.

Figure 2:
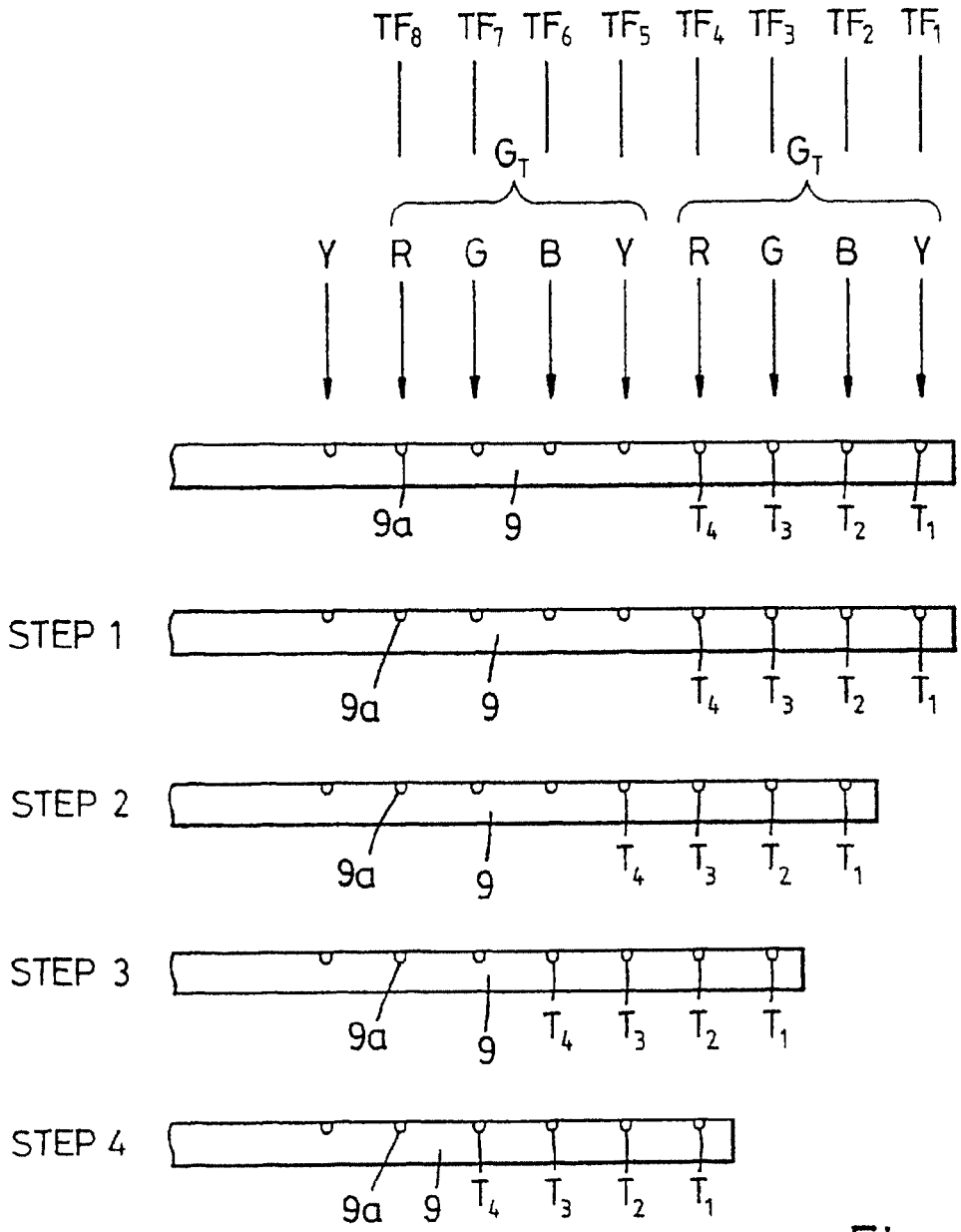
FIG. 2 is a diagrammatic illustration of the tuft loading process using the tuft carrier loading apparatus shown in FIG. 1.

By way of example, the tuft loading process will be described in relation to a pattern wherein three tufts of yarns Y are loaded into tuft retention sites 9*a* identified as $T_1$, $T_2$, $T_4$ and yarn R is loaded into tuft retention site 9*a* identified as $T_3$ (FIG. 2).

At step 1 of the loading process, tuft carrier 9 remains at the first loading position (FIG. 1). Tuft retention site $T_1$ requiring yarn Y is in registry with a tuft feeder 50 at position $TF_1$ and the controller 60 therefore selects and actuates this tuft feeder 50 to feed a tuft of yarn Y into tuft retention site $T_1$. None of the other tuft retention sites $T_2$, $T_3$, $T_4$ is in registry with a tuft feeder 50 having the required colour of yarn and so the tuft feeders 50 at positions $TF_2$-$TF_8$ are not selected and remain inoperative.

At step 2, the driver 70 moves the tuft carrier 9 by one tuft retention site 9*a* spacing to the left as viewed in FIG. 2. In this position, tuft retention site $T_4$ is in registry with the tuft feeder 50 at position $TF_5$ to receive yarn Y and tuft retention site $T_3$ is in registry with the tuft feeder 50 at position $TF_4$ to receive yarn R. Accordingly the controller 60 selects and actuates the tuft feeders 50 at positions $TF_5$ and $TF_4$ to feed tufts of yarns Y and R into tuft retention sites $T_4$ and $T_3$ respectively, and maintains the tuft feeders 50 at the other positions inoperative.

At step 3, the driver 70 again moves the tuft carrier 9 by one tuft retention site 9*a* spacing to the left as viewed in FIG. 2. However, for this step, none of the tuft retention sites 9*a* is in registry with a tuft feeder 50 supplied with the required yarn colour. Consequently the controller 60 does not select or actuate any of the tuft feeders 50 at positions $TF_1$-$TF_8$.

At step 4, the driver 70 moves the tuft carrier 9 by one tuft retention site 9*a* spacing to the left as viewed in FIG. 2. Tuft retention site $T_2$ is now in registry with the tuft feeder 50 at position $TF_5$. Accordingly the controller 60 selects and actuates the tuft feeder 50 at position $TF_5$ to feed a tuft of yarn Y into tuft retention site $T_2$, and maintains the tuft feeders 50 at the other positions inoperative.

Following completion of step 4, sites $T_1$ to $T_4$ are all loaded with tufts in the correct sequence and, to complete the loading process, the tuft carrier 9 is returned to the first position (FIG. 1). It will be appreciated that, whilst not specifically referred to above, the loading of the other tuft retention sites 9*a* of the tuft carrier 9 will also be completed by selection and actuation of the appropriate tuft feeders 50 along the path of travel during each loading step.

A detector (not shown) is associated with each of the tuft retention sites $T_1$ to $T_4$ that detects the presence of a tuft 17 in each of the tuft retention sites.

In the event the detector associated with, for example, tuft retention site $T_1$ fails to detect a tuft 17 following completion of step 4 and the tuft carrier 9 is returned to the first position, the driver 70 moves the tuft carrier 9 so as to move the absent tuft retention site $T_1$ temporarily back into registry with the tuft feeder 50 at position $TF_1$. The controller 60 then selects and re-actuates the tuft feeder 50 at position $TF_1$ to feed a tuft of yarn Y into the absent tuft retention site $T_1$, and maintains the tuft feeders 50 at the other positions inoperative. Thereafter, the tuft carrier 9 is again returned to the first position (FIG. 1).

In embodiments of the invention, the driver 70 may be operable to return the tuft carrier 9 to the first position shown in FIG. 1 immediately after selection and re-actuation of the tuft feeder 50 at position $TF_1$. In other embodiments, the driver 70 may be operable to re-cycle the tuft carrier 9 through steps 2, 3 and 4 before returning the tuft carrier 9 to the first position. In such embodiments, none of the tuft feeders at the other positions are re-actuated during re-cycling of the tuft carrier 9 through steps 2, 3 and 4, In the event the detector associated with tuft retention site $T_1$ detects the presence of a tuft 17, the tuft carrier 9 is then moved to present the tufts 17 in the tuft retention sites 9*a* to the grippers of the loom.

In the event the detector associated with tuft retention site $T_1$ however does not detect the presence of a tuft 17, the controller 60 stops operation of the tuft carrier loading apparatus 10 and the loom. This allows a loom operator to manually insert a tuft of yarn Y into absent tuft retention site $T_1$ before the loom is restarted and the tuft carrier 9 is moved to present the tufts 17 in the tuft retention sites 9*a* to the grippers of the loom.

In use with a 4 yard wide loom having 7 tufts per inch, in which it is necessary to provide 1008 tufts for each row, the tuft carrier 9 includes 1008 tuft retention sites 9*a*. In circumstances where the number of tuft feeders 50 corresponds to the number of tuft retention sites 9*a* of the tuft carrier 9, and a single yarn end is supplied to each tuft feeder 50, the creel of the loom includes 1008 bobbins of yarn.

This represents a significant reduction when compared with the number of bobbins that would be included in the creel of a conventional jacquard Axminster loom of the same size, which would include 4032 (1008×4) bobbins of yarn.

It is envisaged that in other embodiments, the number of different colours of yarn may be changed. In other embodiments, for example, the number of different colours of yarn may be increased to 8. This would represent a reduction of the creel size from 8064 bobbins to 1008 bobbins.

In embodiments in which the number of different colours of yarn is increased to 12, the creel size would be reduced from 12,096 bobbins to 1008 bobbins, and in embodiments in which the number of different colours of yarn is increased to 16, the creel size would be reduced from 16,128 bobbins to 1008 bobbins.

It has not proven practical to produce a carpet incorporating in excess of 16 different colours using a jacquard Axminster gripper loom as a result of the space that would be required to house the resulting creel. A carpet incorporating 20 different colours of yarn woven on the 4 yard wide loom referred to above would, for example, require 20,160 bobbins, a carpet incorporating 24 different colours of yarn would require 24,192 bobbins and a carpet incorporating 42 different colours of yarn would require 42,336 bobbins. The tuft carrier loading apparatus according to the invention however renders it possible to create carpets including such numbers of different colours of yarn in that, for carpets woven on a 4 yard wide loom the creel may be reduced in size to 1008 bobbins, regardless of the number of different colours of yarn incorporated in the carpet.

It will be appreciated that in each of these embodiments, the number of loading positions for the tuft carrier 9 will be changed accordingly.

It will also be appreciated that the number of tuft feeders 50 may be smaller than the number of tuft retention sites 9*a* by a multiple dependent on the number of tuft feeders 50 in each group $G_T$ of yarns, thereby further reducing the number of bobbins in the creel. In such embodiments, loading of the tuft carrier 9 would follow the same process as described above except that the tuft carrier 9 would need to be moved by a greater distance along the path of travel.

In other embodiments, it is envisaged that the tuft carrier 9 may contain an excess number of tuft retention sites 9*a* corresponding to the number of steps in the sequence required to fill the tuft carrier 9 for presentation to the grippers of the loom. Referring to the groups $G_T$ of yarn of the embodiment shown in FIGS. 1 and 2, the excess number of tuft retention sites 9*a* would equate to four sites.

It will be appreciated that this would result in a corresponding increase in the number of tuft feeders 50 and a corresponding increase in the number of bobbins included in the associated creel. Referring to the embodiment shown in FIGS. 1 and 2, this would equate to eight additional tuft feeders 50 created by an additional four tuft feeders 50 provided at each end of the path of travel and therefore eight additional bobbins in the associated creel.

In the 4 yard wide loom referred to above, this would result in an increase from 1008 tuft retention sites 9*a*, 1008 tuft feeders 50 and 1008 bobbins in the creel to 1012 tuft retention sites 9*a*, 1016 tuft feeders 50 and 1016 bobbins in the creel.

This has the advantage of enabling the loading sequence for the tuft carrier 9 to terminate at step 4 in FIG. 2. Once the tuft carrier 9 has been emptied by the grippers of the loom, the loading sequence may then begin in reverse order to that shown in FIG. 2.

It is also envisaged that in other embodiments, a group of yarns may be supplied to each tuft feeder 50, wherein the group of yarns supplied to one tuft feeder 50 is different to the group of yarns supplied to the neighbouring tuft feeder 50.

Accordingly, referring to the embodiment shown in FIG. 1, four different groups of yarns may be supplied via the tuft feeders 50 at positions $TF_1$, $TF_2$, $TF_3$, $TF_4$ (and then repeated at positions $TF_5$ to $TF_8$, etc.).

If each different group of yarns contains, for example, 6 different colours, the choice of colours available for selection from $TF_1$, $TF_2$, $TF_3$, $TF_4$ would be 24 (6×4). Thus, at each loading step, the controller 60 would select the required colour from its group and actuate the tuft feeder 50 to feed a tuft from the selected yarn.

Such a system of feeding different groups of yarns to each neighbouring tuft feeder 50 would enable an Axminster gripper loom to weave selecting from a large number of different coloured yarns.

In embodiments of the invention, the detector associated with each tuft retention site 9*a* may be provided in the form of a light gate at each tuft retention site 9*a*, a tuft 17 in the tuft retention site 9*a* breaking the path of light from an emitter to a detector, thereby allowing the detector to detect the presence of a tuft.

It will be appreciated that in such embodiments the provision of a detector associated with each tuft retention site 9*a* makes it possible to check that the grippers of the loom have removed every tuft from the tuft carrier 9 by cycling a detecting process once, without selecting any tuft feeders 50, immediately after a set of tufts has been removed and inserted into the weaving process. If the tufts were all removed, the detector of each tuft retention site 9*a* will detect the path of light from each corresponding emitter.

A control circuit connected to each detector can then determine where a tuft has been left in a tuft retention site 9*a*, or where other debris such as fluff or loose yarns is left in a tuft retention site 9*a*, by failing to detect a path of light at the detector associated with the tuft retention site 9*a*. This system allows the automatic checking for failure to create tufts and failure of the grippers to select the tufts.

Figure 7:
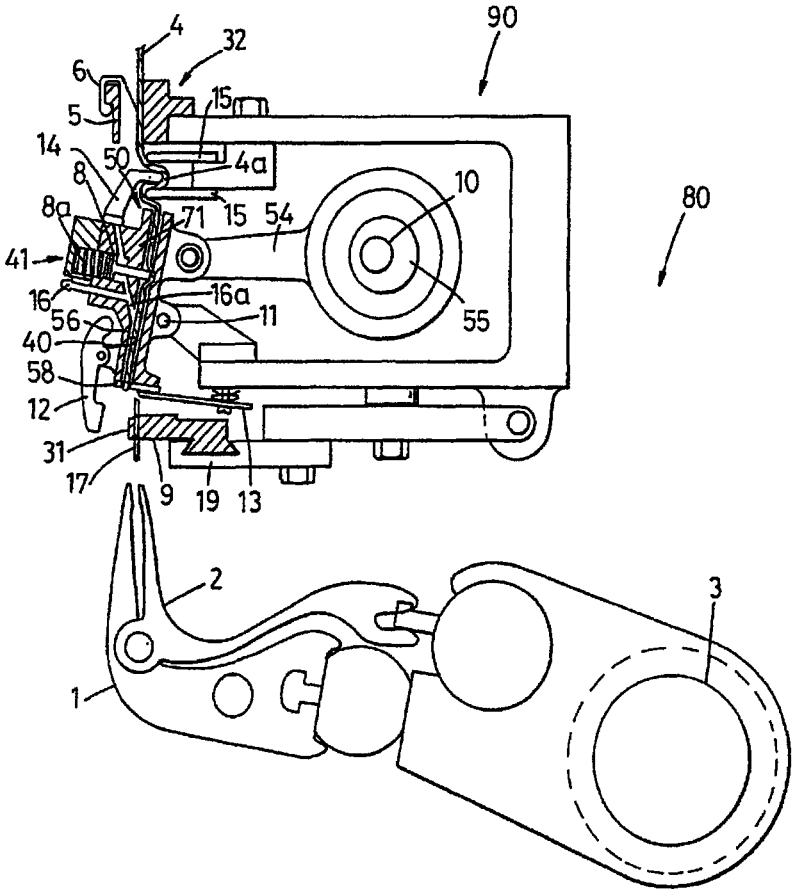
FIG. 7 is a part side view of the loom shown in FIG. 6 showing the tuft carrier loading apparatus in a different operational position to that shown in FIG. 6.

In other embodiments of the invention, the tuft carrier 9 may be manufactured from an electrically insulating material and the bottom of each tuft retention site 9*a* may be fitted with an electrical contact 18 (FIG. 7). In such embodiments, when an electronically conductive finger or pusher 12 presses a tuft 17 into the tuft retention site 9*a*, the tuft 17 prevents a contact being made between the two components. However, the absence of a piece of yarn will allow a contact to be made and this can be detected by a control circuit.

It will again be appreciated that in such embodiments the provision of a detector associated with each tuft retention site 9*a* makes it possible to check that the grippers of the loom have removed every tuft by cycling the detecting process once without selecting any tuft feeders 50, immediately after the set of tufts has been removed. If the pushers or contacts in the tuft carrier 9 are individually sensed, each contact should be made if every tuft has been removed.

As with embodiments employing detectors in the form of light gates, a control circuit connected to each pusher or contact can then determine where a tuft has been left by failing to detect a connection between the two parts at the appropriate point in the loom cycle. This system allows the automatic checking for failure to create tufts and failure of the grippers to select the tufts.

Figure 4:
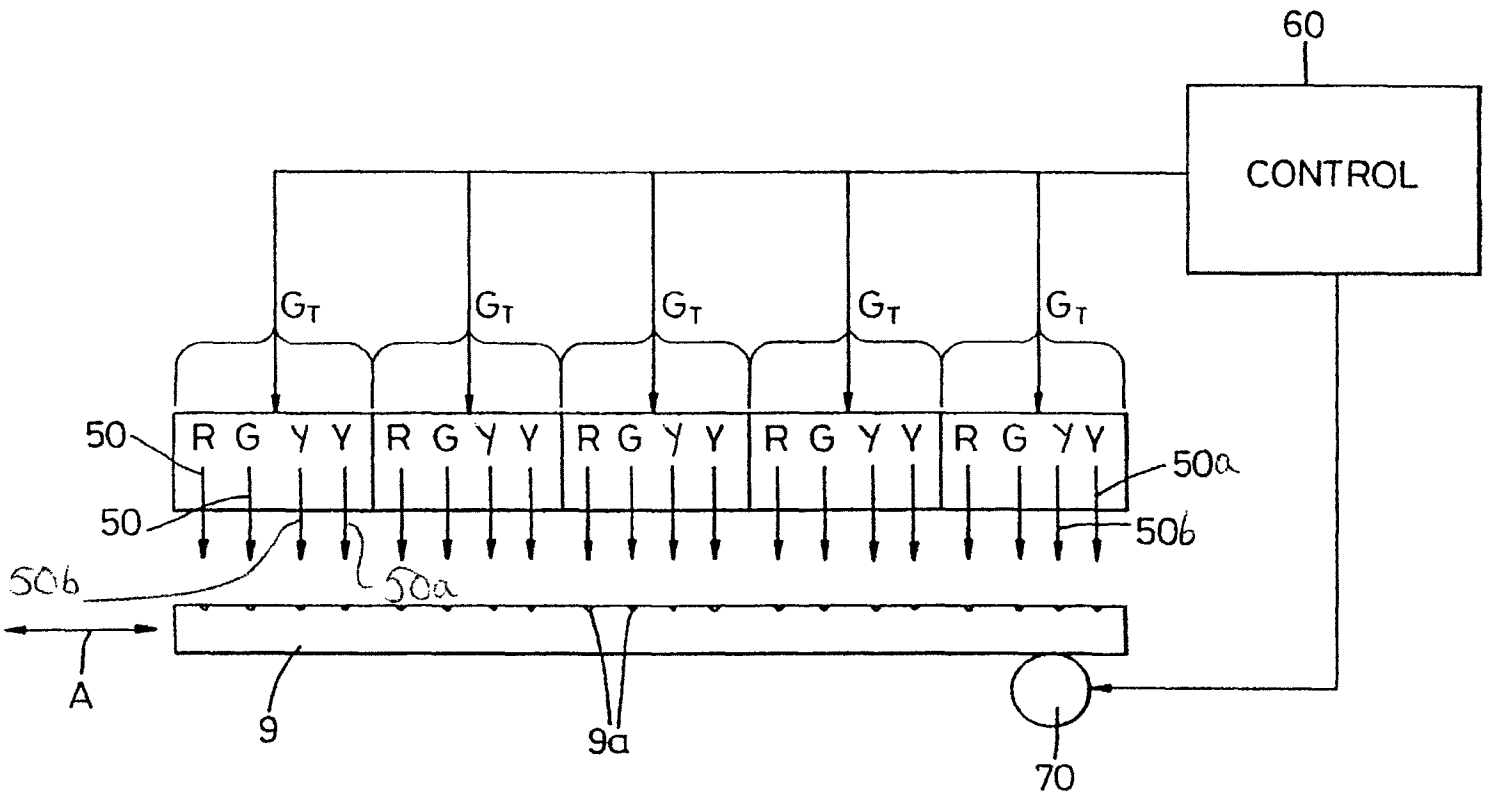
FIG. 4 is a schematic diagram of a tuft carrier loading apparatus according to another embodiment of the invention.

A tuft carrier loading apparatus 10 according to another embodiment of the invention is shown in FIG. 4.

The structure of the tuft carrier loading apparatus 10 is essentially the same as that shown in FIG. 1 except that each group $G_T$ of tuft feeders 50 includes three different colours R, G, Y as opposed to four. The tuft feeders 50 are arranged to include primary tuft feeders 50*a* at positions $TF_1$ and $TF_5$ supplying yarn Y and secondary tuft feeders 50*b* at positions $TF_2$ and $TF_6$ also supplying yarn Y. The tuft feeders 50 at positions $TF_3$ and $TF_7$ supply yarn G whilst the tuft feeders 50 at positions $TF_4$ and $TF_8$ supply yarn R.

As outlined above with reference to FIGS. 1 and 2, at the start of the loading process, the tuft carrier 9 is located at a first loading position (as shown) whereat each tuft retention site 9*a* is in registry with a respective tuft feeder 50.

Figure 5:
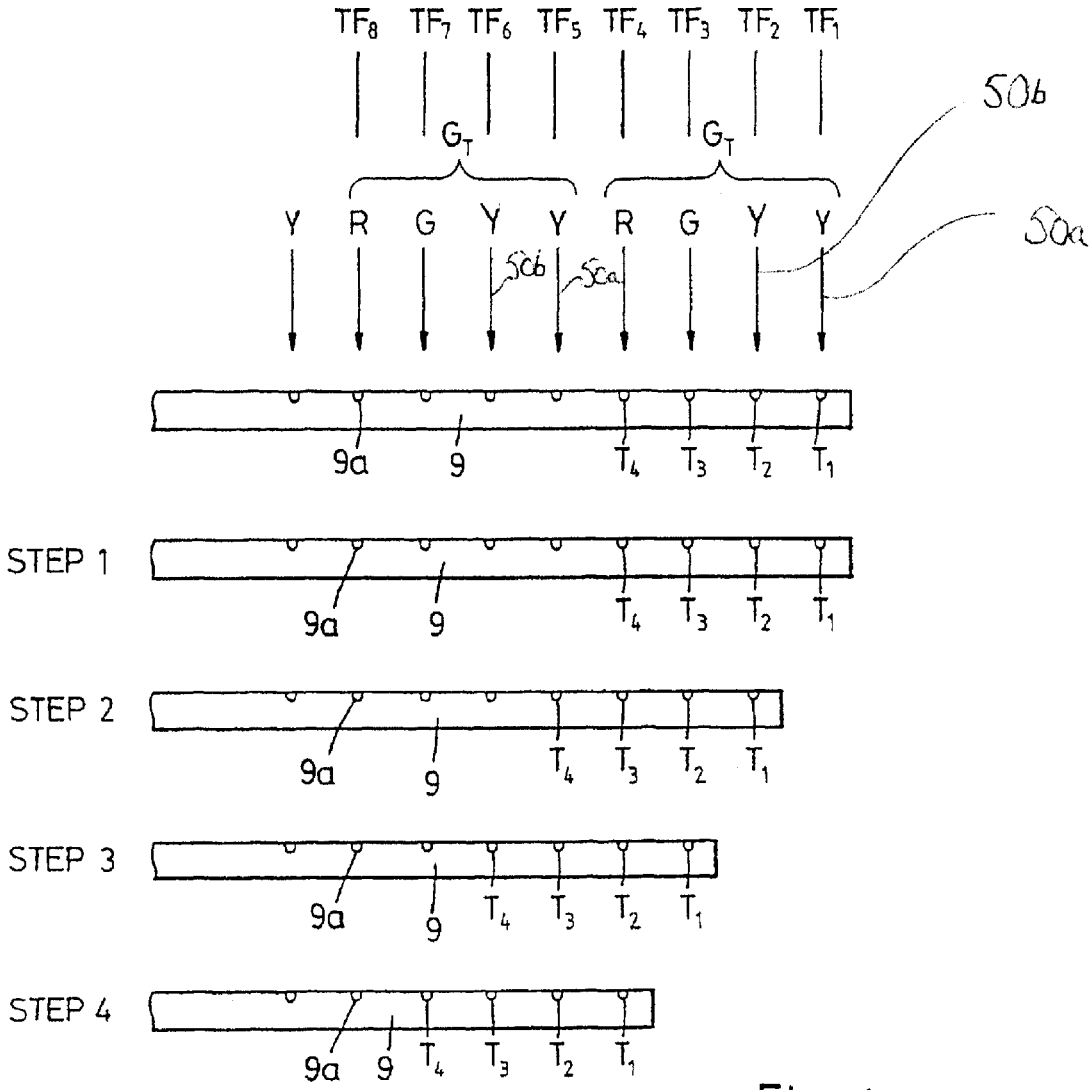
FIG. 5 is a diagrammatic illustration of the tuft loading process using the tuft carrier loading apparatus shown in FIG. 4.

By way of the same example, the tuft loading process will be described in relation to a pattern wherein three tufts of yarns Y are loaded into tuft retention sites 9*a* identified as $T_1$, $T_2$, $T_4$ and yarn R is loaded into tuft retention site 9*a* identified as $T_3$ (FIG. 5).

At step 1 of the loading process, tuft carrier 9 remains at the first loading position (FIG. 4). Tuft retention site $T_1$ requiring yarn Y is in registry with the primary tuft feeder 50*a* at position $TF_1$ and the controller 60 therefore selects and actuates this tuft feeder 50 to feed a tuft of yarn Y into tuft retention site $T_1$. None of the other tuft retention sites $T_2$, $T_3$, $T_4$ is in registry with a tuft feeder 50 having the required colour of yarn and so the tuft feeders 50 at positions $TF_2$-$TF_8$ are not selected and remain inoperative.

At step 2, the driver 70 moves the tuft carrier 9 by one tuft retention site 9*a* spacing to the left as viewed in FIG. 5. In this position, tuft retention site $T_4$ requiring yarn Y is in registry with the primary tuft feeder 50*a* at position $TF_5$ and tuft retention site $T_3$ requiring yarn R is in registry with the tuft feeder 50 at position $TF_4$. Accordingly the controller 60 selects and actuates the primary tuft feeder 50*a* at position $TF_5$ and the tuft feeder 50 at position $TF_4$ to feed tufts of yarns Y and R into tuft retention sites $T_4$ and $T_3$ respectively. The controller 60 maintains the tuft feeders 50 at the other positions inoperative.

At step 3, the driver 70 again moves the tuft carrier 9 by one tuft retention site 9*a* spacing to the left as viewed in FIG. 2. However, for this step, none of the tuft retention sites 9*a* is in registry with a tuft feeder 50 supplied with the required yarn colour. Consequently the controller 60 does not select or actuate any of the tuft feeders 50 at positions $TF_1$-$TF_8$.

At step 4, the driver 70 moves the tuft carrier 9 by one tuft retention site 9*a* spacing to the left as viewed in FIG. 2. Tuft retention site $T_2$ requiring yarn Y is now in registry with the primary tuft feeder 50*a* at position $TF_5$. Accordingly the controller 60 selects and actuates the primary tuft feeder 50*a* at position $TF_5$ to feed a tuft of yarn Y into tuft retention site $T_2$, and maintains the tuft feeders 50 at the other positions inoperative.

Following completion of step 4, sites $T_1$ to $T_4$ are all loaded with tufts in the correct sequence and, to complete the loading process, the tuft carrier 9 is returned to the first position (FIG. 4). It will be appreciated that, whilst not specifically referred to above, the loading of the other tuft retention sites 9*a* of the tuft carrier 9 will also be completed by selection and actuation of the appropriate tuft feeders 50 along the path of travel during each loading step.

As with the embodiment shown in FIGS. 1 and 2, a detector (not shown) is associated with each of the tuft retention sites $T_1$ to $T_4$ to detect the presence of a tuft 17 in each of the tuft retention sites.

In the event the detector associated with, for example, tuft retention site $T_1$ fails to detect a tuft 17 following completion of step 1 the controller 60 selects and actuates the secondary tuft feeder 50*b* at position $TF_2$ to feed a tuft of yarn Y into the absent tuft retention site $T_1$ at step 2 when the absent tuft retention site $T_1$ is in registry therewith.

In the event the detector associated with tuft retention site $T_1$ detects the presence of a tuft 17, the tuft carrier 9 will be returned to the first position following completion of step 4 from where it will is then be moved to present the tufts 17 in the tuft retention sites 9*a* to the grippers of the loom.

In the event the detector associated with tuft retention site $T_1$ however continues to fail to detect a tuft 17 following completion of step 4 and the tuft carrier 9 is returned to the first position, the driver 70 moves the tuft carrier 9 so as to move the absent tuft retention site $T_1$ temporarily back into registry with the primary tuft feeder 50*a* at position $TF_1$. The controller 60 then selects and re-actuates the primary tuft feeder 50*a* at position $TF_1$ to feed a tuft of yarn Y into the absent tuft retention site $T_1$, and maintains the tuft feeders 50 at the other positions inoperative. Thereafter, the tuft carrier 9 is re-cycled through steps 2, 3 and 4 before being again returned to the first position (FIG. 4).

In the event the detector associated with tuft retention site $T_1$ detects the presence of a tuft 17, none of the tuft feeders at the other positions are re-actuated during re-cycling of the tuft carrier 9 through steps 2, 3 and 4, and the tuft carrier 9 is then moved to present the tufts 17 in the tuft retention sites 9*a* to the grippers of the loom.

In the event the detector associated with tuft retention site $T_1$ however does not detect the presence of a tuft 17, the controller 60 selects and re-actuates the secondary tuft feeder 50*b* at position $TF_2$ to feed a tuft of yarn Y into the absent tuft retention site $T_1$ when the yarn carrier 9 is re-cycled to step 2 and the absent tuft retention site $T_1$ is in registry therewith.

In the event the detector associated with tuft retention site $T_1$ continues to fail to detect the presence of a tuft 17 after re-actuation of both the primary and secondary tuft feeders 50*a*,50*b* at positions $TF_1$ and $TF_2$, the controller 60 stops operation of the tuft carrier loading apparatus 10 and the loom. This allows a loom operator to manually insert a tuft of yarn Y into absent tuft retention site $T_1$ and repair the faulty primary and secondary tuft feeders 50*a*,50*b* before the loom is restarted and the tuft carrier 9 is moved to present the tufts 17 in the tuft retention sites 9*a* to the grippers of the loom.

It will be appreciated that in other embodiments the driver 70 may return the tuft carrier 9 immediately to the first position shown in FIG. 4 in the event the primary tuft feeder 50*a* fails to insert a tuft into tuft retention site $T_1$ following re-actuation thereof. This would lead to cessation of the loom without allowing the controller 60 to select and re-actuate the secondary tuft feeder 50*b* at step 2.

In the embodiments described above with reference to FIGS. 1 and 4, the tuft carrier loading apparatus 10 preferably includes a display connected to the detectors. This allows the apparatus 10 to display information identifying absent tuft retention sites 9*a* to a loom operator.

Preferably the information displayed on the display updates during operation of the tuft carrier loading apparatus 10 such that on successful feeding of a tuft into an absent tuft retention site 9*a*, the display updates to remove reference to that tuft retention site 9*a*. The loom operator is thereby kept informed of the identity of faulty tuft feeders 50, even if the faults in those tuft feeders 50 rectify themselves. This allows the loom operator, on identifying repeated failures of a tuft feeder 50, to choose to stop the loom and replace or otherwise repair the tuft feeder 50.

On cessation of the loom and the tuft carrier loading apparatus 10 as a result of repeated failure of the tuft feeder 50 to feed a tuft 17 into an absent tuft retention site 9*a*, the display will identify the absent tuft retention site 9*a*. This allows the loom operator to readily identify and remedy the missing tuft so as to allow restarting of the loom as quickly as possible and thereby minimise cessation time of the loom.

A loom 80 including the tuft carrier loading apparatus 10 of FIGS. 1 and 2 is shown in FIGS. 6 to 9.

The tuft carrier 9 is located in a guide 19 to guide its longitudinal movement along the path of travel previously mentioned. The tuft carrier 9 includes a toothed rack 31 which meshes with a pinion gear (not shown) driven by the driver 70.

The tuft carrier loading apparatus 10 is located directly above the main grippers 1 of the loom 80 such that when the tuft carrier 9 is at its first position, the grippers 1 are able to rise and grip the full row of tufts 17 held by the tuft carrier 9.

Once the tuft carrier 9 has been emptied of tufts 17 by the grippers 1, the tuft loading process begins in readiness to provide a fully loaded tuft carrier 9 by the time the grippers 1 rise again.

Each tuft feeder 50 includes a body 71 which is pivotally mounted at 11 on the loom frame for reciprocal movement between a tuft feed position (FIG. 6) and a tuft loop forming position (FIG. 7). The body 71 is continuously reciprocated between the feed and loop forming positions by a connection rod 54 driven by an eccentric 55 on a drive shaft 10. The drive shaft 10 is driven by the main shaft of the loom 80 and so is in synchronism with the motion of the grippers 1.

Yarn 4 is supplied to each tuft feeder 50 via a yarn feed 32 and extends from the yarn feed 32 along a passageway 40 in which is located a yarn trap 41 in the form of a fluid operated plunger 8 biased by a spring 8*a* to a yarn gripping position.

A yarn trap 6 is located at the yarn feed 32 so as to enable yarn to be drawn from the feed under tension and held in position once the tension has been removed.

The body 71 carries a yarn loop forming finger 14 which is arranged to engage the yarn 4 extending between the yarn feed 32 and yarn trap 41 each time that the body 71 moves to the loop forming position.

As seen in FIG. 7, a loop 4*a* is formed by the finger 56 pushing yarn 4 between a pair of spaced static fingers 15.

The length of the yarn 4 drawn from feed 32 (and hence the length of the eventual tuft) is determined by the relative displacement of finger 14 and fingers 15 and this may be adjusted by either mounting fingers 15 on the loom frame and/or mounting finger 14 on body 71 such that their position is adjustable.

The plunger 8 normally grips yarn 4 in the passageway 40 and so the loop 4*a* is formed during reciprocation of the body 71 by drawing yarn from the yarn feed 32. This creates slack yarn between the yarn feed 32 and trap 41 in readiness for feeding to the tuft carrier 9. If the tuft feeder 50 is selected to create a tuft, the trap 41 is activated to release the yarn 4 by applying high pressure air via conduit 16; the high pressure fluid also being directed along passageway 40 via conduit 16*a*. Activation of the trap 41 preferably occurs as the body 11 swings forwardly away from fingers 15.

Accordingly the slack yarn is drawn into the passageway 40 as the fingers 14, 15 move apart.

At this stage the yarn 4 is projecting from the bottom of the body 71 and as the top half of the main body 71 reaches the extent of its travel, the bottom part of the main body 71 is moving backwards carrying the yarn into the slots of the tuft carrier 9. As the yarn enters the slot of the tuft carrier 9 a set of narrow presser fingers 12 push the yarn into the slots and as they do so, the yarn is cut by the scissor action of the blade 13 and the bottom of the passageway 40 containing the yarn. A hardened plate 58 is mounted to the bottom of the main body 71 and the yarn passes through holes in this plate which form the other side of the scissor. The fingers 12 are designed to make contact with the yarn just before the yarn is cut and so the tuft 17 is held in place as it is cut from the yarn source. Each finger 12 is spring loaded (not shown) and pivoted so that the correct amount of force can be applied to the tuft.

Conveniently body 71 of each tuft forming means 50 comprises a unitary block 56 in which a plurality of side by side passages 40 are formed.

Figure 8:
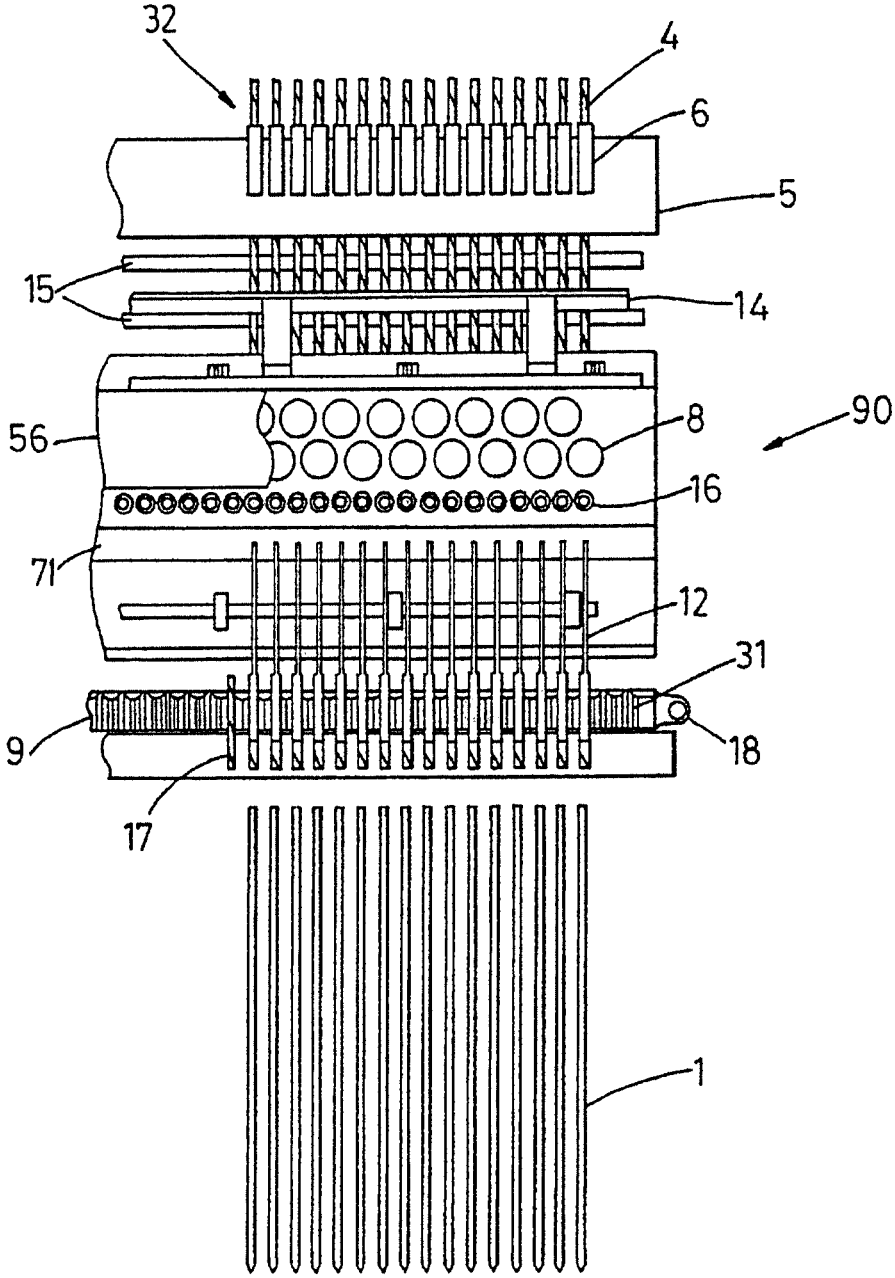
FIG. 8 is a front view of the loom shown in FIG. 6.
Figure 9:
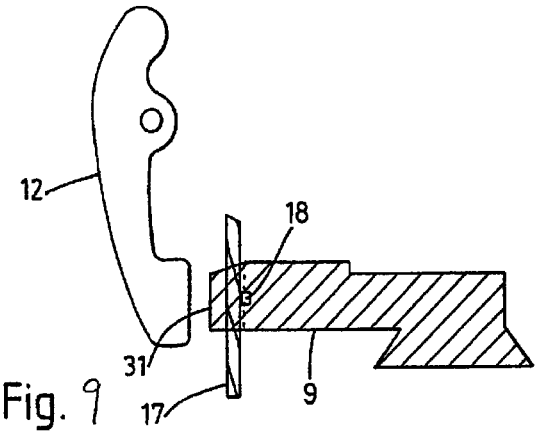
FIG. 9 is an enlarged part view of the tuft carrier of the tuft carrier loading apparatus of the loom shown in FIG. 6.

As seen in FIG. 8 the plunger 8 of adjacent tuft forming means 50 are staggered in order to enable the tuft feeder 50 to be closely spaced.

Figure 10:
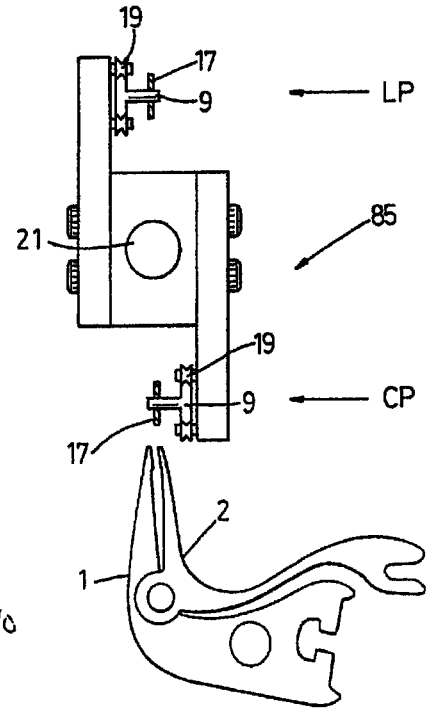
FIG. 10 is a part side view of a loom including a tuft carrier of a tuft carrier loading apparatus according to another embodiment of the invention.

As described above, a single tuft carrier 9 is located beneath the tuft feeders 50 and holds the tufts 17 in readiness for collection by the grippers 1. It is envisaged that a tuft carrier transfer mechanism may be included in order to remove a loaded tuft carrier 9 from the tuft feeders 50 to present it to a remote collection position whereat the tufts are collected by the grippers. Such an arrangement creates a buffer system where pre-loaded tuft carriers 9 are stored for transfer to the collection position. Such a buffer system may have many sets of tuft carriers or it could consist of as few as two sets. A transfer mechanism 85 in FIG. 10 which includes two sets of tuft carriers 9. Each tuft carrier 9 is mounted on a rotatable shaft 21 in respective guides 19. The shaft 21 is rotatable between two fixed positions so as to successively move each carrier to a loading position LP and a collection position CP. The carrier at the collection position CP presents the tufts 17 to the main grippers, while the other tuft carrier 9 at the loading position LP allows the tuft carrier to be extracted and a loaded one installed or to be loaded in-situ. However the removal and replacement of a tuft carrier would be sequential operations hence reducing the time available for loading. This problem would not arise if the tuft carrier was fixed and hence not removed from the rotating mechanism 85; the loading apparatus would then need to traverse this fixed tuft carrier to place the tufts 17

A triple position rotating mechanism 85 would allow simultaneous extraction of an empty tuft carrier and replacement of a loaded one. A four position mechanism 85 may have a redundant position but could present the loading and collection positions in a more convenient orientation.

Where it is possible to operate the loading apparatus faster than the rate of use of yarn, the creation of a buffer of filled tuft carriers is possible. In this case a failure in the operation of the loading device does not require the immediate cessation of the loom. Due to the nature of the material used as pile yarns, failure to grip and select the yarn can occur for a number of reasons. This can be remedied by manual intervention and a buffer store could supply the loom while the corrective action is taken.

An alternative type of tuft carrier could take the form of a flexible belt system. It may be possible to form a specially profiled, double-sided toothed belt that could be driven by the teeth on the inner surface and hold tufts in specially profiled slots on the outer surface.

Figure 11:
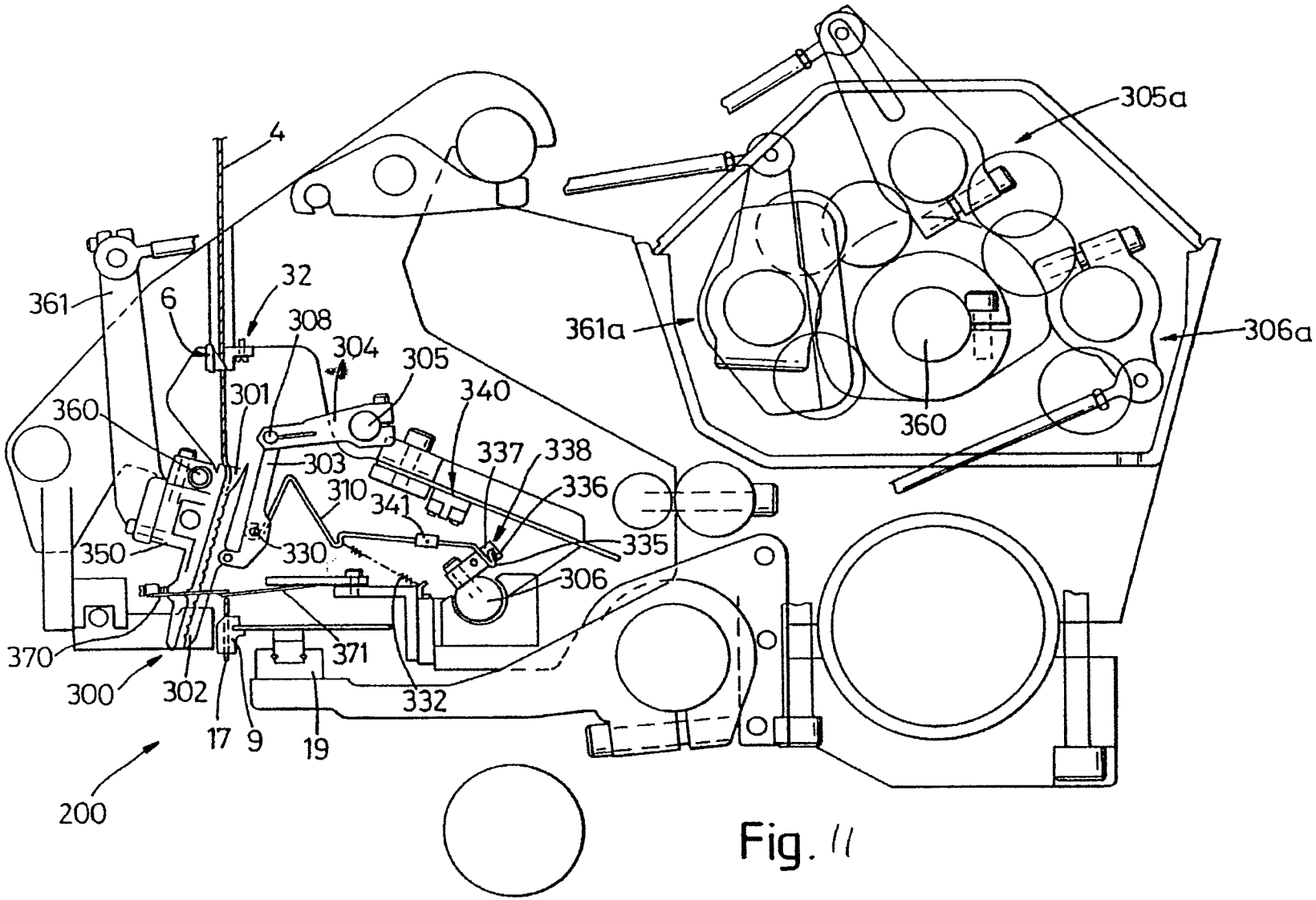
FIG. 11 is a part side view of a loom including a tuft feeder according to a further embodiment of the invention.
Figure 12:
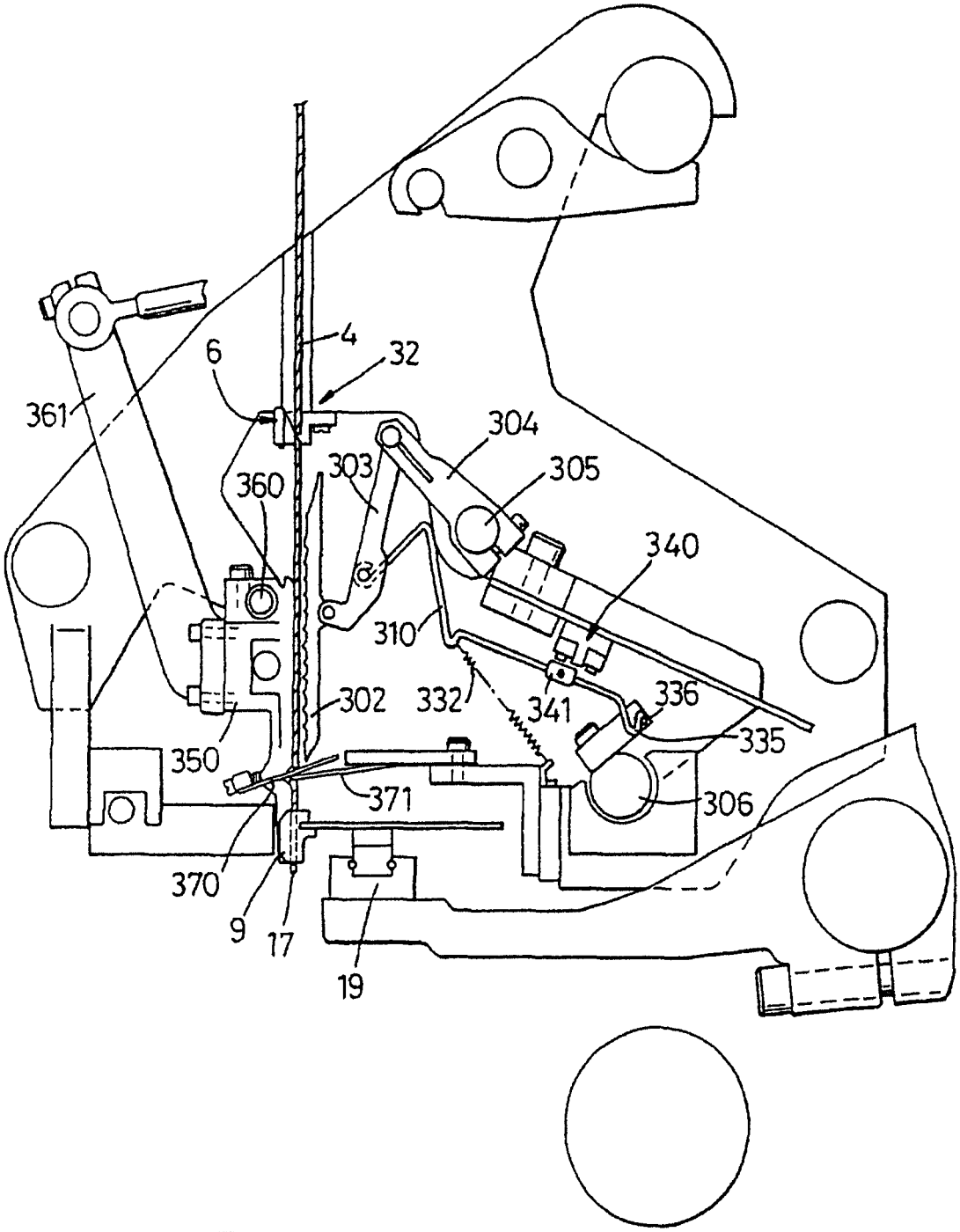
FIG. 12 is a part side view of the loom shown in FIG. 11 showing the tuft feeder in a different operational position.

In other embodiments, the tuft feeders 50 may be replaced with the tuft feeder 200 shown in FIGS. 11 and 12.

In the embodiment shown in FIGS. 11 and 12, a series of individual mechanical grippers 300 are utilised for drawing each tuft forming yarn 4 from the yarn feed 32. (In FIGS. 11 and 12 only a single gripper 300 is shown.)

The gripper 300 includes a yarn guide in the form of a channel 301 along which a gripping claw 302 continuously reciprocates.

The claw 302 is mounted on a connecting lever 303 which is driven by a drive arm 304 extending from a reciprocating drive shaft 305. The drive shaft 305 is reciprocated by a conjugate cam 305*a* which co-operates with a main drive shaft 360.

The lever 303 is pivotally attached to the drive arm 304 by a pivotal connection 308. The lever 303 is also pivotally connected to a reciprocating shaft 306 via a connecting link 310. The shaft 306 is reciprocated by a conjugate cam 306*a*.

The link 310 is connected at one end to lever 303 via a pivotal connection 330 and is biased in a direction away from channel 301 by resilient means preferably in the form of a spring 332. The opposite end of link 310 includes a latch formation 335, preferably in the form of a hook, for selective engagement with a latch 336, in the form of a peg, mounted within a slot 337 formed in an arm 338 projecting from the shaft 306.

The connecting link 310 is operable to move the claw 302 toward the base of the channel 301 and thereby enable it to grip yarn 4 located in the channel 301 and draw it from the yarn feed 32 during its downward stroke or to move the claw 302 away from the base of the channel 301 and thereby space the claw 302 sufficiently away from the base of the channel to prevent it drawing yarn from the yarn feed 32 during its downward stroke.

Control of the position of claw 302 by link 310 is achieved as follows. Spring 332 normally biases the link 310 and thus claw 302 away from the base of channel 310. Accordingly provided that latches 335 and 336 are not engaged, the claw 302 will be spaced from the base of channel 301 and will not engage yarn 4.

Movement of the claw 302 toward the base of the channel 301 is achieved by engagement of latches 335, 336 and advancement of arm 338 toward channel 301.

Engagement of latches 335, 336 is achieved by lifting of arm 304 which raises link 310 to the position shown in FIG. 12. Each link 310 is provided with an anvil 341 which is magnetically attractable to an electromagnet 340. If the electromagnet 340 is energised, the link 310 is retained at its uppermost position as the shaft 306 moves arm 338 forward toward the channel 301 and accordingly latches 335 and 336 are engaged to push the link 310 forward also.

The link 310 is resiliently deformable to accommodate forward movement of the arm 338 and to also resiliently urge the claw 302 into engagement with the yarn 4. Preferably the link 310 is formed from a resilient wire.

If tuft formation is not required, then the electromagnet 340 is not energised. Accordingly, when arm 304 lowers, the link 310 is also lowered and this is timed to occur before arm 338 moves forward. Accordingly, latch 335 drops below latch 336 and is not engaged so that continual forward movement of arm 338 has no effect on link 310.

The channel 301 is formed in a block 350 which is pivotally mounted on the machine frame via a pivotal connection 360. The block 350 is reciprocated by arm 361 which in turn is reciprocated by a conjugate cam 361*a*. The block 350 pivots outwardly to a tuft feed position as shown in FIG. 7 whilst the claw 302 moved downwardly to draw yarn 4. The block then pivots inwardly as shown in FIG. 12 to push drawn yarn into the tuft carrier 9 and sever the yarn 4 to form tuft 17 by means of a cutting blade 370 mounted on the block 350 co-operating with a static blade 371.

It is envisaged that in yet further embodiments the tuft carrier loading apparatus according to the present invention may be located to one side of the loom instead of being located directly above the grippers 1. Each tuft carrier 9 would then be loaded with a row of tufts and thereafter the tuft carrier would be inserted sideways into the path of the secondary set of main grippers.

The tuft carrier may take the form of a single unit holding a complete row of tufts or be divided into narrower sections. In the case of a four yard wide loom, if the tuft carrier was one yard wide, the complete filling device would not need to be much greater than that width. The exact layout of the arrangement can take several forms depending on the priorities of simplification, space requirements, size of a creel, access to the back of the loom etc.

Where the loading apparatus is to the side of the loom, the filled tuft carrier can be transported sideways into a rotating selector or other form of buffer storage system. The empty tuft carrier can be refilled during the extraction or replacement process so that its transverse movement facilitates the sequential filling of sections of the tuft carrier as it passes the loading apparatus. Whether the tuft carrier needs to be released from the rotating selector immediately after use or it can be extracted from the selector in stages during the filling process would depend on the ratio of the filling time to the transporting time.

It is also envisaged that the tuft carrier may be filled behind the weaving position, with either the tuft carrier or loading apparatus traversing the appropriate amount. Using this method, it is also possible to fill all tuft sites in the tuft carrier, section by section. In the case of a four yard wide tuft carrier, loaded in four sections, after the first section was loaded, the loading apparatus or the tuft carrier would traverse by one yarn to allow the adjacent section to be loaded. Alternatively, every fourth yarn location can be filled simultaneously and the loading device or the tuft carrier moved transversely by one tuft location between loading operations. This method distributes the yarn ends over the width of the tuft carrier so that the lateral movement is very much reduced. It also allows the intermediate positions to be filled with additional yarn carriers, removing the advantage of a smaller creel but allowing many colours to be achieved. Typically a twelve colour yarn carrier allows a maximum of twelve different colours to be incorporated into the carpet. Four adjacent twelve colour yarn carriers could contain forty-eight different colours permitting the production of carpet more typical of Spool Gripper looms. Whether the tuft carrier moves one yarn end at a time or by a larger section, the tuft carrier can carry out the required lateral movement by means of guides on the rotating selector or by removal from the selector, using another guiding mechanism.

The invention claimed is:

1. A tuft carrier loading apparatus for loading individual tufts into tuft retention sites spaced along an elongate tuft carrier, the apparatus including:

a guide for guiding longitudinal movement of the tuft carrier along a path of travel;

a plurality of individually and selectively operable tuft feeders spaced along the path of travel, each tuft feeder being operable when selected to feed an individual tuft to a tuft retention site of the tuft carrier;

a driver drivingly connected to the tuft carrier for moving the tuft carrier along the path of travel, the driver being operable to intermittently move the tuft carrier through a series of successive positions whereat predefined tuft retention sites are moved temporarily into registry with each tuft feeder; and a controller for controlling selection of the tuft feeders, the controller being operable to actuate selected tuft feeders to feed tufts to those tuft retention sites in registry therewith whilst the carrier is located at each successive position, characterised in that the tuft carrier loading apparatus further includes a detector associated with each tuft retention site to detect the presence of a tuft and the driver, on detection of an absent tuft in a tuft retention site following actuation of one or more selected tuft feeders resulting in failure to feed a tuft to the absent tuft retention site, is operable to move the tuft carrier into a position whereat the absent tuft retention site is moved temporarily back into registry with the or one selected tuft feeder and the controller re-actuates the selected tuft feeder to feed a tuft to the absent tuft retention site and wherein the controller further including the step of stopping operation of the tuft carrier loading apparatus on detection of an absent tuft in a tuft retention site following re-actuation of the selected tuft feeder resulting in failure to feed a tuft to the absent tuft retention site.

2. A tuft carrier loading apparatus according to claim 1 wherein the tuft feeders include primary and secondary tuft feeders in sequence for predefined tuft retention sites, the primary and secondary tuft feeders being supplied with tuft yarn having the same characteristic, and the controller is operable to select and actuate the primary tuft feeders to feed tufts to the predefined tuft retention sites when they are moved temporarily into registry therewith and, on detection of an absent tuft in one or more of the predefined tuft retention sites following actuation of the corresponding primary tuft feeder resulting in failure to feed a tuft to the absent tuft retention site, the controller being operable to select and actuate the corresponding secondary tuft feeder to feed a tuft to the absent tuft retention site when it is moved temporarily into registry therewith.

3. A tuft carrier loading apparatus according to claim 1 further including a display to display information identifying any absent tuft retention sites.

4. A tuft carrier loading apparatus according to claim 1 wherein tuft yarn is supplied to neighbouring tuft feeders in a predefined sequence, the sequence being repeated along the path of travel.

5. A tuft carrier loading apparatus according to claim 1 wherein each tuft feeder includes a tuft yarn feed that receives tuft yarn from a tuft yarn source, selectively operable yarn drawing means for drawing a predetermined length of tuft yarn from the tuft yarn feed to form a tuft forming yarn portion and one or more cutting blades to sever the tuft forming yarn portion from the remainder of the yarn to form a tuft.

6. A tuft carrier loading apparatus according to claim 5 wherein the yarn drawing means includes a selectively operable yarn gripper which, on selection, reciprocally drives so as to grip the tuft yarn during one of its strokes of reciprocation in order to draw yarn from the yarn feed.

7. A tuft carrier loading apparatus according to claim 6 wherein the yarn gripper includes a reciprocally mounted yarn engaging claw which is continuously reciprocated, the claw being movably mounted between yarn engage position whereat it engages yarn during the one stroke of reciprocation and a yarn disengage position whereat it does not engage yarn during the one stroke.

8. A tuft carrier loading apparatus according to claim 6 wherein the yarn gripper includes a reciprocally mounted body including a yarn passageway containing a selectively operable yarn trap for movement between a yarn release position and a yarn trap position, the body further including a yarn engaging member located between the yarn trap and the yarn feed, the yarn engaging member engaging the yarn extending between the yarn feed and trap during reciprocation of the body to form a loop of yarn by drawing yarn from the yarn feed when the trap is at its yarn trap position, a fluid supply being provided for drawing yarn along the passageway in a direction away from the yarn feed when the selectively operable yarn trap has been moved to its yarn release position.

9. A weaving loom including a tuft carrier loading apparatus according to claim 1.

10. A weaving loom according to claim 9 wherein the loom is an Axminster gripper loom.

11. A method of loading an elongate tuft carrier with tufts, the elongate tuft carrier having a plurality of tuft retention sites spaced along its length, the method including the steps of:

guiding longitudinal movement of the tuft carrier along a path of travel, arranging a plurality of individually and selectively operable tuft feeders in spaced relationship along the path of travel, driving the tuft carrier intermittently through a series of successive positions so that predefined tuft retention sites are moved temporarily into registry with each tuft feeder, and selecting and actuating selected tuft feeders to feed tufts to those tuft retention sites in registry therewith whilst the tuft carrier is located at each successive position, characterised in that the method further includes the steps of detecting the presence of a tuft in each tuft retention site and, on detection of an absent tuft in a tuft retention site following actuation of one or more selected tuft feeders resulting in failure to feed a tuft to the absent tuft retention site, driving the tuft carrier into a position whereat the absent tuft retention site is moved temporarily back into registry with the or one selected tuft feeder and re-actuating the selected tuft feeder to feed a tuft to the absent tuft retention site further including the step of the controller stopping operation of the tuft carrier loading apparatus on detection of an absent tuft in a tuft retention site following re-actuation of the selected tuft feeder resulting in failure to feed a tuft to the absent tuft retention site.

12. A method of loading an elongate tuft carrier with tufts according to claim 11 further including the steps of providing primary and secondary tuft feeders in sequence for predefined tuft retention sites, the primary and secondary tuft feeders being supplied with tuft yarn having the same characteristic, and selecting and actuating the primary tuft feeders to feed tufts to the predefined tuft retention sites when they are moved temporarily into registry therewith and, on detection of an absent tuft in one or more of the predefined tuft retention sites following actuation of the corresponding primary tuft feeder resulting in failure to feed a tuft to the absent tuft retention site, selecting and actuating the corresponding secondary tuft feeder to feed a tuft to the absence tuft retention site when it is moved temporarily into registry therewith.

13. A method of loading an elongate tuft carrier with tufts according to claim 11 further including the step of displaying information on a display to identify any absent tuft retention sites.

14. A method of weaving on an Axminster loom wherein for each pick of the loom, a tuft carrier loaded with tufts according to the method of claim 11 is arranged to present the tufts to the grippers of the loom.

* * * * *